US007165620B2

(12) United States Patent
Steedman

(10) Patent No.: US 7,165,620 B2
(45) Date of Patent: Jan. 23, 2007

(54) WELLHEAD COMPLETION SYSTEM HAVING A HORIZONTAL CONTROL PENETRATOR AND METHOD OF USING SAME

(75) Inventor: Scott Steedman, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 10/328,535

(22) Filed: Dec. 23, 2002

(65) Prior Publication Data

US 2004/0118568 A1 Jun. 24, 2004

(51) Int. Cl.
*E21B 33/035* (2006.01)
*E21B 33/038* (2006.01)
*E21B 34/04* (2006.01)

(52) U.S. Cl. ..... 166/368; 166/88.4; 166/344; 166/347

(58) Field of Classification Search ..... 166/344, 166/347, 368, 88.4, 242.5
See application file for complete search history.

(56) References Cited

U.S. PATENT DOCUMENTS

| | | | | |
|---|---|---|---|---|
| 3,638,732 | A * | 2/1972 | Huntsinger et al. | 166/379 |
| 3,678,998 | A * | 7/1972 | Cockrell et al. | 166/123 |
| 4,067,388 | A | 1/1978 | Mouret et al. | 166/208 |
| 4,181,175 | A * | 1/1980 | McGee et al. | 166/88.4 |
| 4,476,935 | A | 10/1984 | Hynes et al. | 166/373 |
| 4,589,492 | A | 5/1986 | Greiner et al. | 166/338 |
| 4,623,020 | A | 11/1986 | Nichols | 166/88 |
| 4,702,320 | A * | 10/1987 | Gano et al. | 166/343 |
| 4,848,472 | A * | 7/1989 | Hopper | 166/344 |
| 4,852,611 | A | 8/1989 | Knerr et al. | 137/595 |
| 4,863,314 | A * | 9/1989 | Baugh | 405/191 |
| 5,029,647 | A * | 7/1991 | Milberger et al. | 166/367 |
| 5,555,935 | A | 9/1996 | Brammer et al. | 166/88.1 |
| 5,558,532 | A | 9/1996 | Hopper | |
| 5,730,473 | A | 3/1998 | Wilkins et al. | 285/26 |
| 5,865,250 | A | 2/1999 | Gariepy | 166/375 |
| 5,941,574 | A | 8/1999 | Hamilton et al. | |

(Continued)

FOREIGN PATENT DOCUMENTS

EP 1132572 2/2001

(Continued)

OTHER PUBLICATIONS

International Search Report PCT/US 03/05714 dated Sep. 18, 2003.

*Primary Examiner*—Jennifer H. Gay
(74) *Attorney, Agent, or Firm*—Williams, Morgan & Amerson, P.C.

(57) ABSTRACT

A well completion system includes a completion device defining a bore therein attached to a wellhead and a tool, disposed within the bore, comprising an operational element and a control receptacle in communication with the operational element. The system further includes a horizontal penetrator assembly disposed external to the completion device and comprising at least one horizontal penetrator capable of being extended into and retracted from the bore to engage the control receptacle such that the horizontal penetrator is in communication with the operational element of the tool. A method includes inserting a tool into a bore of a completion device, engaging a horizontal penetrator with a control receptacle of the tool, and operating an element of the tool via the horizontal penetrator.

32 Claims, 8 Drawing Sheets

U.S. PATENT DOCUMENTS

| | | | | |
|---|---|---|---|---|
| 5,947,642 | A * | 9/1999 | Teixeira et al. | 405/195.1 |
| 6,237,690 | B1 | 5/2001 | Nicholson | |
| 6,394,837 | B1 * | 5/2002 | Edwards et al. | 439/426 |
| 6,675,900 | B1 * | 1/2004 | Baskett et al. | 166/379 |
| 6,681,861 | B1 * | 1/2004 | Davidson et al. | 166/382 |
| 2002/0088622 | A1 * | 7/2002 | Beall et al. | 166/342 |
| 2002/0189817 | A1 | 12/2002 | Davidson et al. | |
| 2005/0051336 | A1 * | 3/2005 | Bartlett | 166/344 |

FOREIGN PATENT DOCUMENTS

| | | | |
|---|---|---|---|
| WO | 01/55549 | A1 | 2/2001 |

* cited by examiner

WELLHEAD COMPLETION SYSTEM HAVING A HORIZONTAL CONTROL PENETRATOR AND METHOD OF USING SAME

BACKGROUND OF THE INVENTION

1. Field of the Invention

This invention relates to oilfield completion systems and, in particular, to a wellhead completion system having a horizontal control penetrator and a method of using same.

2. Description of the Related Art

For many conventional subsea oil and gas wells, a series of pipes, fittings, valves, and gauges are used on the wellhead to control the flow. This plumbing is known as a Christmas or production tree and is generally attached to the wellhead via a subsea connector. Often, one or more horizontal penetrators are installed in a Christmas tree to engage permanently installed components of the wellhead, such as a tubing hanger or an insert landed in the Christmas tree. Such engagements typically are used to provide electrical and/or hydraulic power to the components or to provide connectivity to downhole sensors and the like.

Temporary tools, such as running and retrieving tools, are typically engaged by an internal umbilical running through the riser alongside the temporary tool. Such a configuration, however, may result in higher installation costs and may require more time to install. Having the umbilical between the riser and the temporary tool often necessitates the use of a blowout preventer spanner joint, so that the blowout preventer rams can seal properly in the case of a well blowout.

The present invention is directed to overcoming, or at least reducing, the effects of one or more of the problems set forth above.

SUMMARY OF THE INVENTION

In one aspect of the present invention, a well completion system is provided. The well completion system includes a completion device defining a bore therein attached to a wellhead and a tool, disposed within the bore, comprising an operational element and a control receptacle in communication with the operational element. The system further includes a horizontal penetrator assembly disposed external to the completion device and comprising at least one horizontal penetrator capable of being extended into and retracted from the bore to engage the control receptacle such that the horizontal penetrator is in communication with the operational element of the tool.

In another aspect of the present invention, a method is provided including inserting a tool into a bore of a completion device, engaging a horizontal penetrator with a control receptacle of the tool, and operating an element of the tool via the horizontal penetrator.

In yet another aspect of the present invention an apparatus is provided. The apparatus includes means for communicating fluids produced from a wellhead and means for performing an operation within at least one of the wellhead and the means for communicating the fluids produced from the wellhead. The apparatus further includes means for selectively engaging and communicating with the means for performing the operation.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1A:
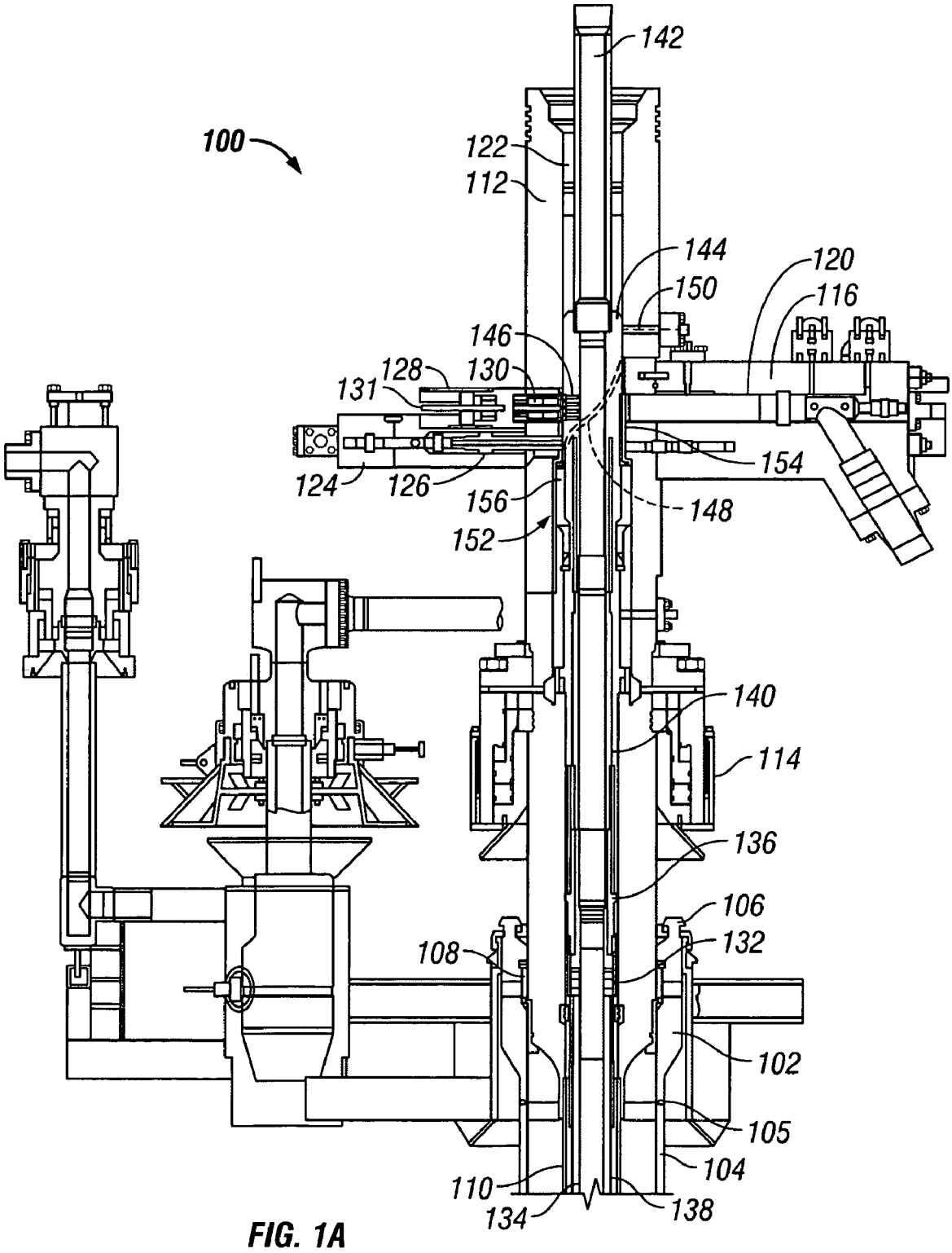
FIG. 1A is partial cross-sectional view of an illustrative embodiment of a well completion system according to the present invention into which a tubing hanger is being installed.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention is directed to a well completion system having one or more horizontal penetrators capable of being extended into and retracted from a bore of a completion device (e.g., a Christmas or production tree, etc.), such that the penetrators are engaged with or disengaged from one or more control receptacles (e.g., hydraulic and/or electrical receptacles or the like) of a tool disposed within the bore of the completion device. In this way, various operational elements of the tool (e.g., pistons, actuators, wireline devices, valves, etc.) may be operated via the horizontal penetrators. The tool elements being operated may be above or below the control receptacles. In one embodiment, the horizontal penetrators are engageable by a remotely operated vehicle (ROV), and external umbilical, or the like. Thus, in such an embodiment, various elements of the tool may be remotely operated via an ROV, an external umbilical, or the like.

In one embodiment, a hot stab is provided on the completion device. An ROV engages the hot stab with a rotary tool thereof and winds the horizontal penetrators into the tool element to be operated. Alternatively, the hot stab may be engaged by an external umbilical to actuate the horizontal penetrators and, thus, operate the tool element.

Further, the well completion system may, in some embodiments, include an isolation sleeve for protecting the horizontal penetrators or other elements of the completion device as tools are run into and out of the completion device bore. In one embodiment, a hot stab is provided on the completion device, with hydraulic lines extending between the isolation sleeve and the hot stab. An ROV engages the hot stab and fluid from the ROV is used to hydraulically operate the isolation sleeve. Alternatively, the hot stab may be engaged by an external umbilical to actuate the isolation sleeve.

Figure 1B:
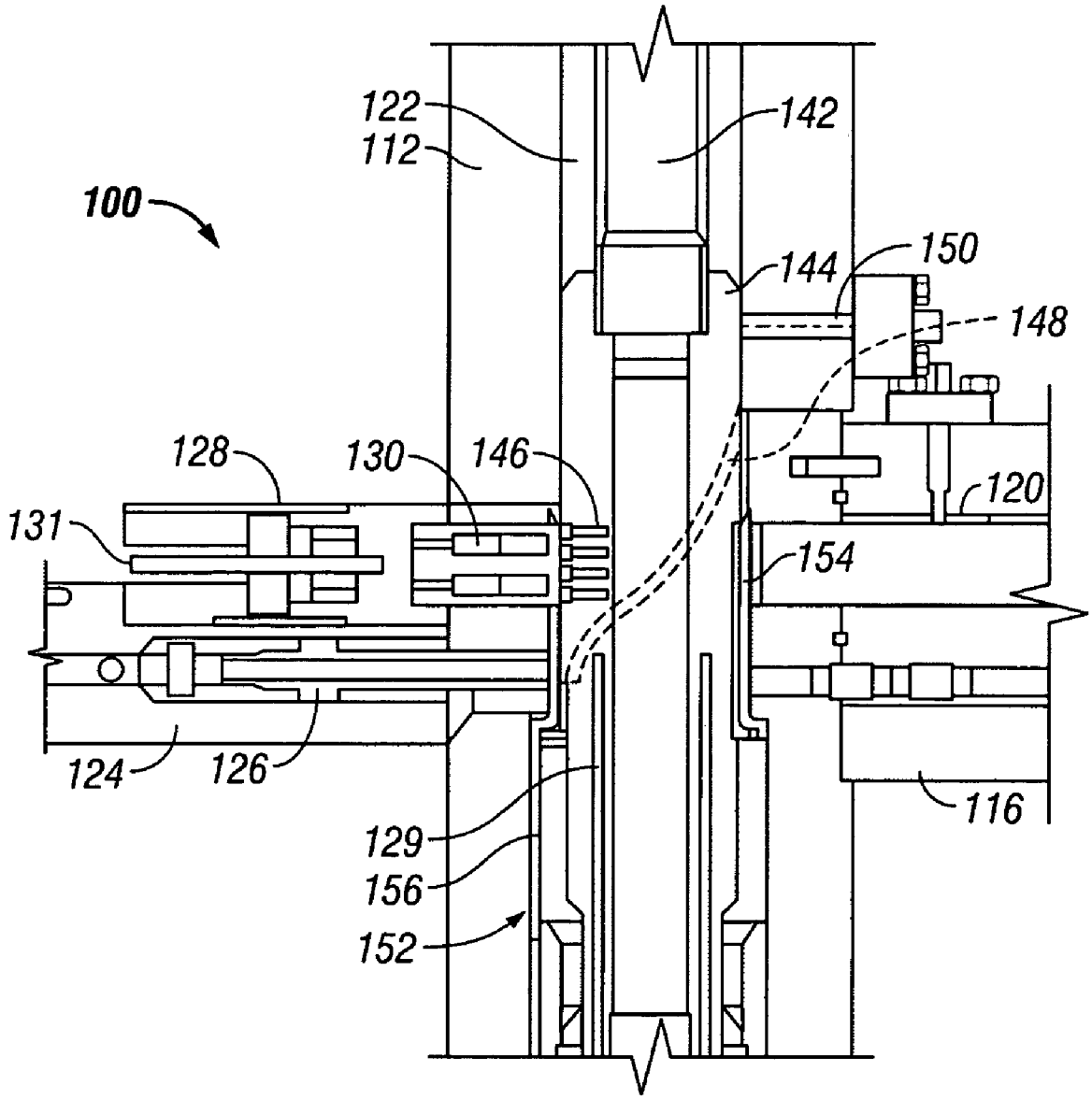
FIGS. 1B–1D are enlarged views of portions of the well completion system of FIG. 1A.
Figure 1C:
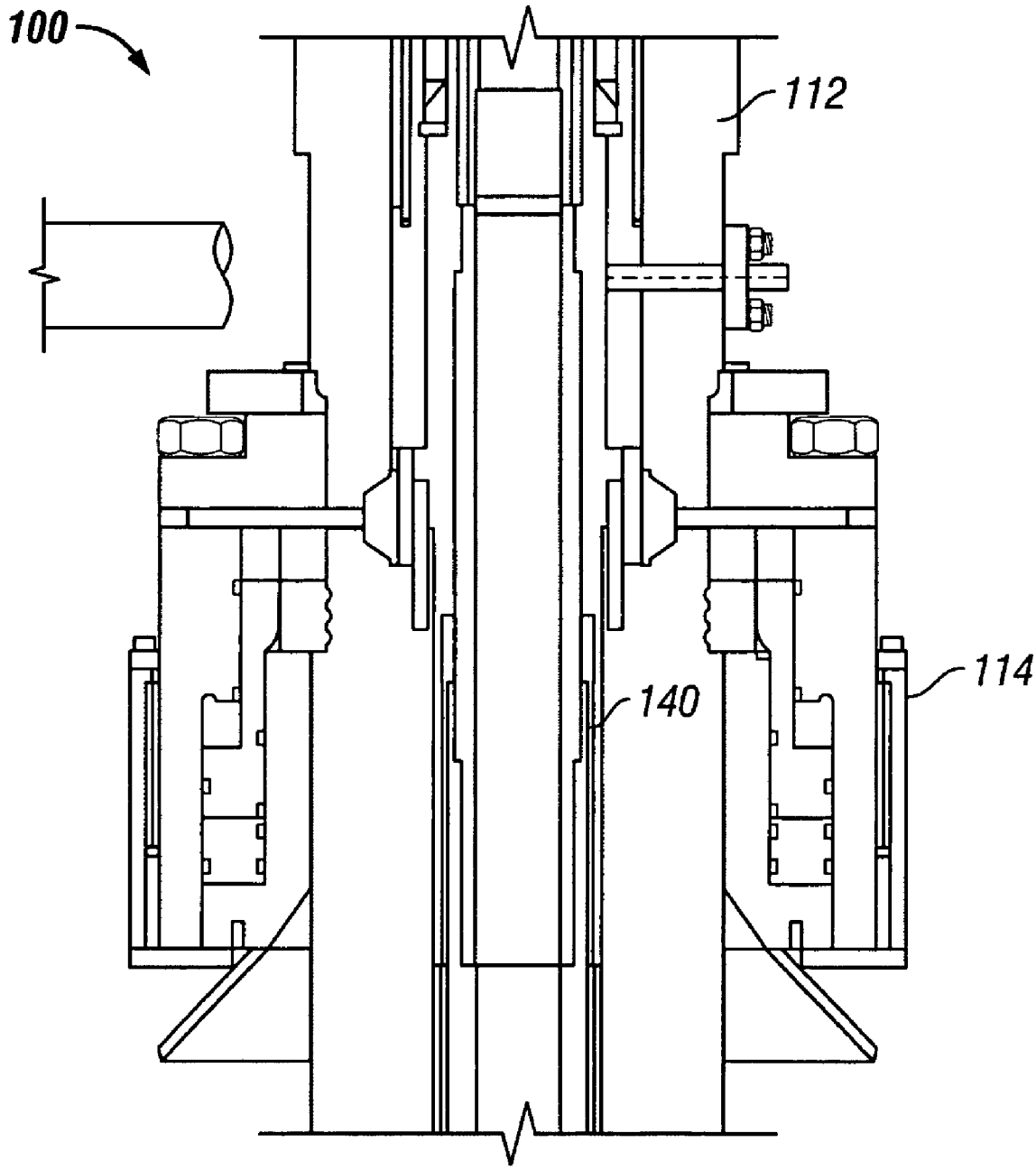
Figure 1D:
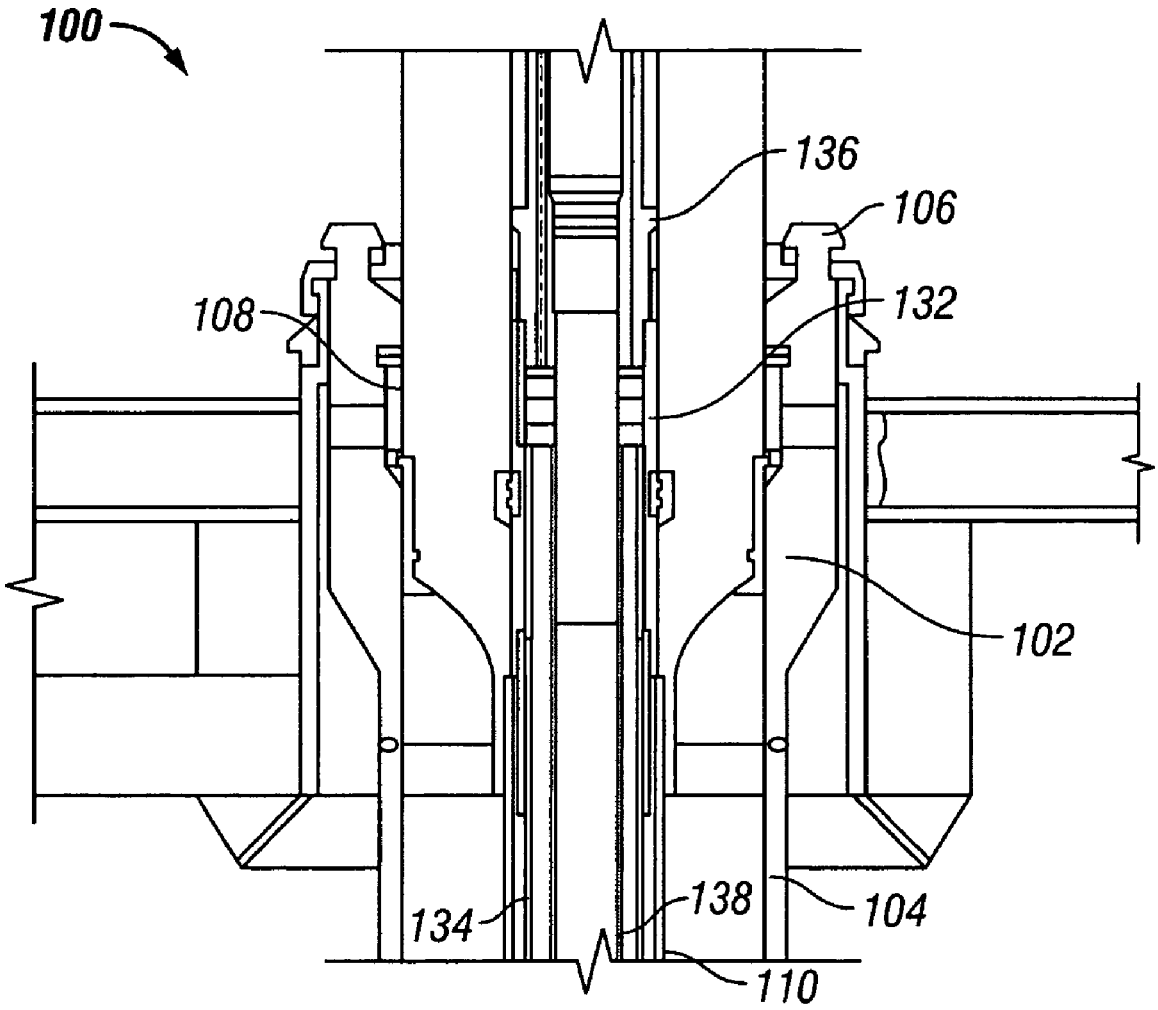

Although it may take on many forms, FIGS. 1A–1D depict an illustrative embodiment of a well completion system 100 according to the present invention into which a tubing hanger 136 is being installed. FIG. 1A is an overall view of the well completion system 100 and FIGS. 1B–1D are enlarged views of portions of the well completion system 100. The illustrated embodiment of the well completion system 100 comprises a conductor housing 102 that is welded or otherwise attached to a conductor pipe 104. A completion guide base 106 is supported on the outer diameter of the conductor housing 102. Landed within the conductor housing 102 is a wellhead 108, which supports an outer casing string 110. A Christmas or production tree 112, which is but one type of completion device, is connected to the top of the wellhead 108 via a tree connector 114. Thus, by way of example and illustration, the Christmas tree 112 is but one means for communicating fluids produced from the wellhead 108 employed in accordance with the present invention.

Still referring to FIGS. 1A–1D, a production valve block 116 is disposed on the side of the Christmas tree 112. The production valve block 116 comprises production flow control valves (not shown) for controlling the flow of oil and/or gas from the well. The valve block 116 further includes a retractable production isolation sleeve 120, which can be retracted from or extended into a bore 122 of the Christmas tree 112. Also, disposed on the side of the Christmas tree 112, is an annulus valve block 124, which includes a retractable annulus isolation sleeve 126, which can also be retracted from or extended into the bore 122 of the Christmas tree 112.

The well completion system 100 further includes a horizontal penetrator assembly 128, which is also disposed on the side of the Christmas tree 112. The horizontal penetrator assembly 128 comprises one or more horizontal penetrators 130 that can be retracted from or extended into the bore 122 of the Christmas tree 112 to sealingly engage various hydraulic and/or electrical control lines 129 (one shown in FIG. 1B) of a tool disposed within the bore 122, such that the one or more horizontal penetrators is in communication with operational elements of the tool. Thus, by way of example and illustration, the horizontal penetrator 130 is but one means for selectively engaging and communicating with the tool in accordance with the present invention. In the illustrated embodiment, the horizontal penetrator assembly 128 is adapted to be engaged by a remotely operated vehicle, an external umbilical, or the like, via a coupling 131, for actuating the horizontal penetrators 130 into or out of the bore 122 of the Christmas tree 112 and for operating various operational elements of tools that may be disposed within the bore 122.

Still referring to FIGS. 1A–1D, a casing hanger 132 is landed in the wellhead 108 and supports a production casing string 134. In the illustrated embodiment, the tubing hanger 136 is run into the well via a tubing hanger running tool 140, which is suspended on a running string 142 within the bore 122, and is landed in the wellhead 108 above the casing hanger 132 for supporting a production tubing string 138. Thus, by way of example and illustration, the tubing hanger running tool 140 is but one means for performing an operation within at least one of the wellhead 108 and the Christmas tree 112 employed in accordance with the present invention. The tubing hanger running tool 140 comprises an upper section 144, which includes one or more control receptacles 146 for receiving the horizontal penetrators 130. The tubing hanger running tool 140 further comprises an orientation slot 148, which in the illustrated embodiment has a helical shape, for engaging an orientation pin 150 for orienting the tubing hanger 136 within the wellhead 108 and for orienting the tubing hanger running tool 140 within the bore 122 of the Christmas tree 112, such that the horizontal penetrators 130, the production isolation sleeve 120, and the annulus isolation sleeve 126 may be engaged with the Christmas tree 112.

In the illustrated embodiment, a sliding isolation sleeve 152 (see FIG. 1B) is disposed within the bore 122 of the Christmas tree 112 and includes an upper portion 154 and a lower portion 156. The lower portion 156 acts as a piston of a hydraulic actuator for moving the sleeve up and down within the bore 122 of the Christmas tree 112. In one embodiment, the sliding isolation sleeve 152 is hydraulically actuated by an ROV or an external umbilical, such that, for example, fluid is urged from the ROV or the external umbilical, through the horizontal penetrators 130, to the sliding isolation sleeve 152. When the sliding isolation sleeve 152 is in an upper position (as shown in FIGS. 1A and 1B), the upper portion 154 isolates the horizontal penetrators 130, the production isolation sleeve 120, and the annulus isolation sleeve 126, thus inhibiting debris from fouling these components as tools are run through the bore 122 of the Christmas tree 112. After the tubing hanger 136 is landed in the wellhead 108, the sliding isolation sleeve 152 can be actuated to the lower position, uncovering the horizontal penetrators 130, the production isolation sleeve 120, and the annulus isolation sleeve 126. The horizontal penetrators 130 can then be extended to engage the control receptacles 146 in the upper section 144 of the tubing hanger running tool 140 such that the tubing hanger running tool 140 can be operated. Thus, the functions of the tubing hanger running tool 140 and any downhole devices can be controlled, for example, by a remotely operated vehicle or an external umbilical attached to the penetrator assembly 128. After the tubing hanger running tool 140 has been used to perform the desired operations and the horizontal penetrators 130 have been retracted, the sliding isolation sleeve 152 can be actuated to the upper position and the tubing hanger running tool 140 can be removed.

Figure 2A:
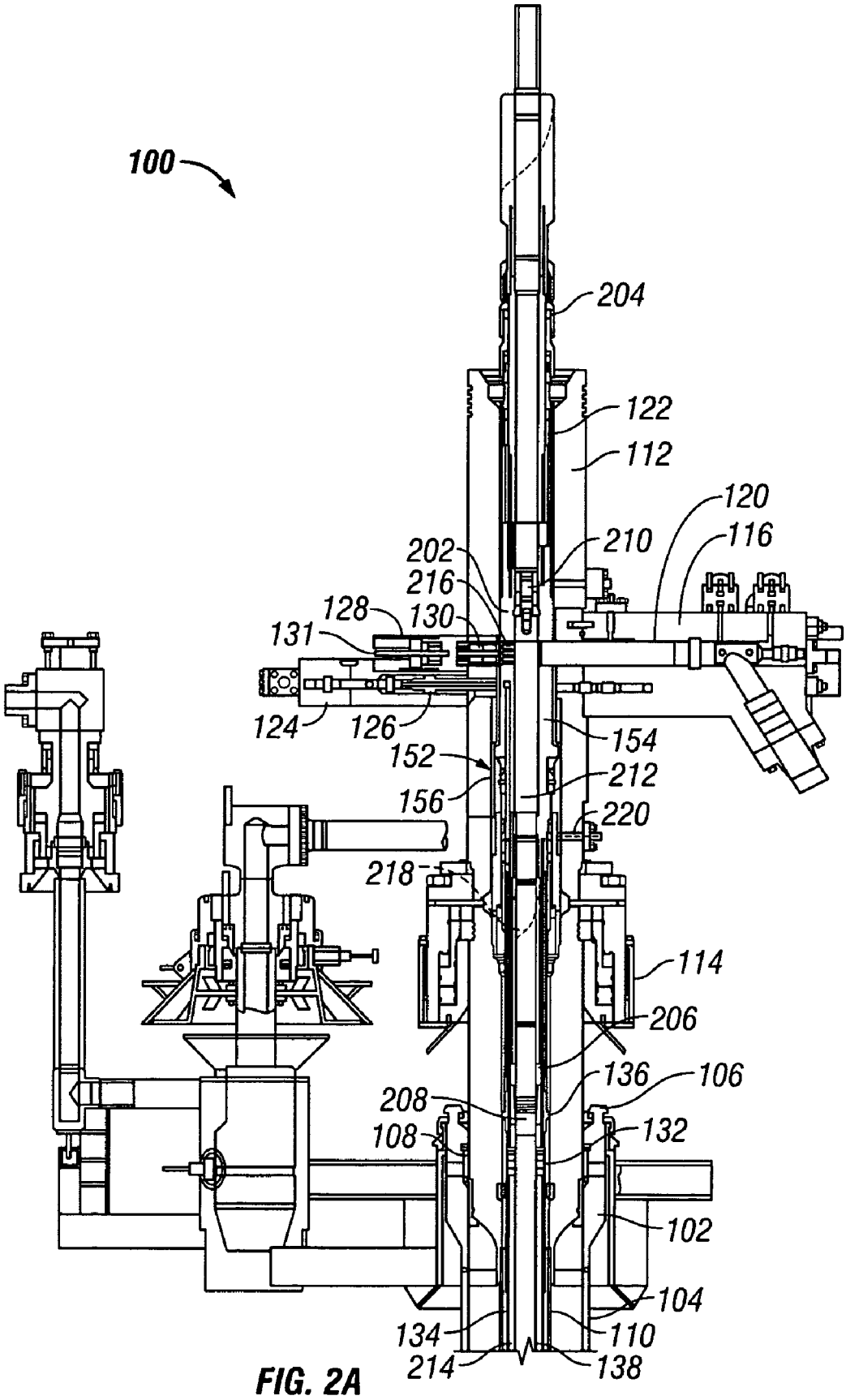
FIG. 2A is partial cross-sectional view of the well completion system of FIG. 1A into which a tubing hanger is being installed.
Figure 2B:
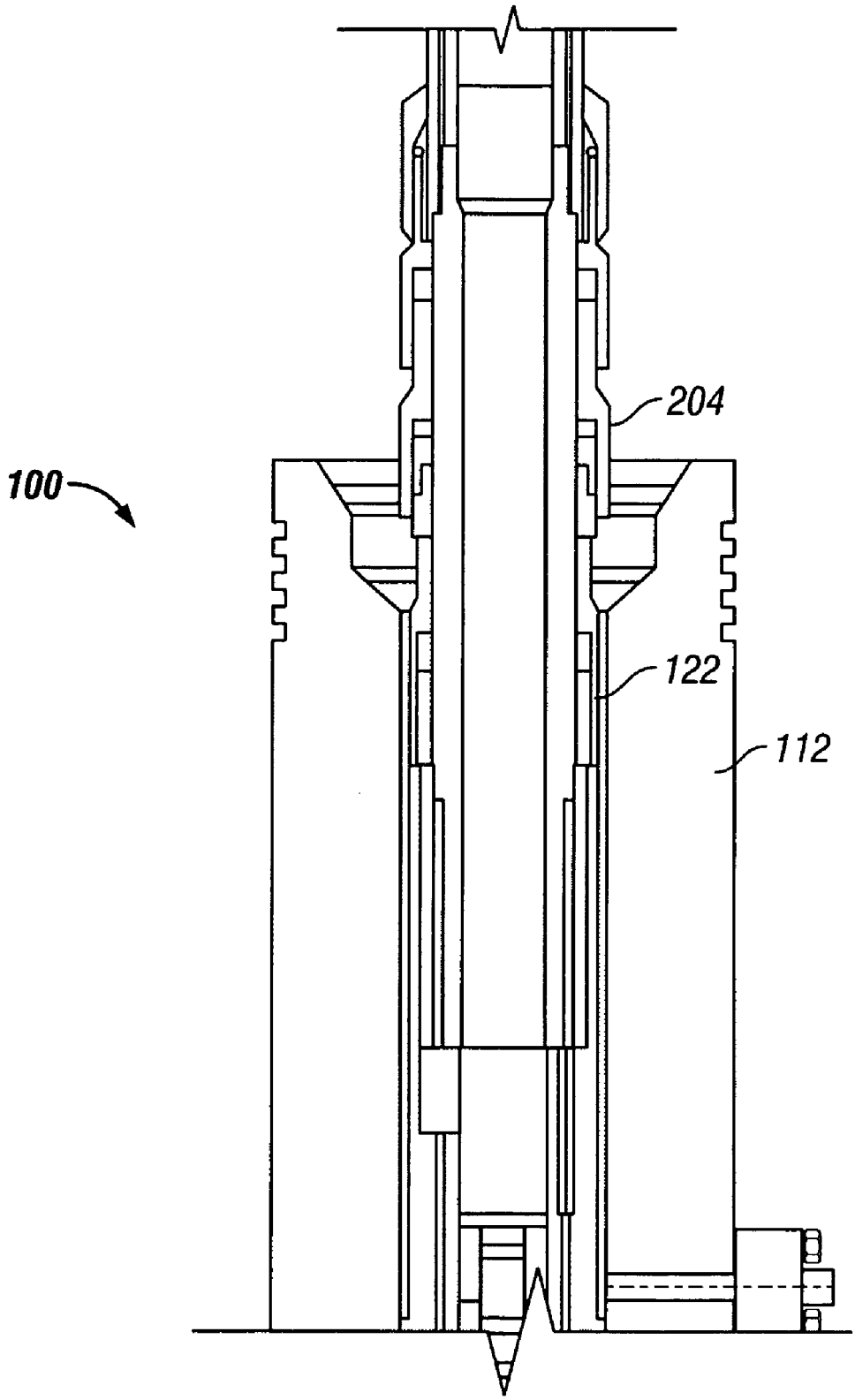
FIGS. 2B–2D are enlarged views of portions of the well completion system of FIG. 2A.
Figure 2C:
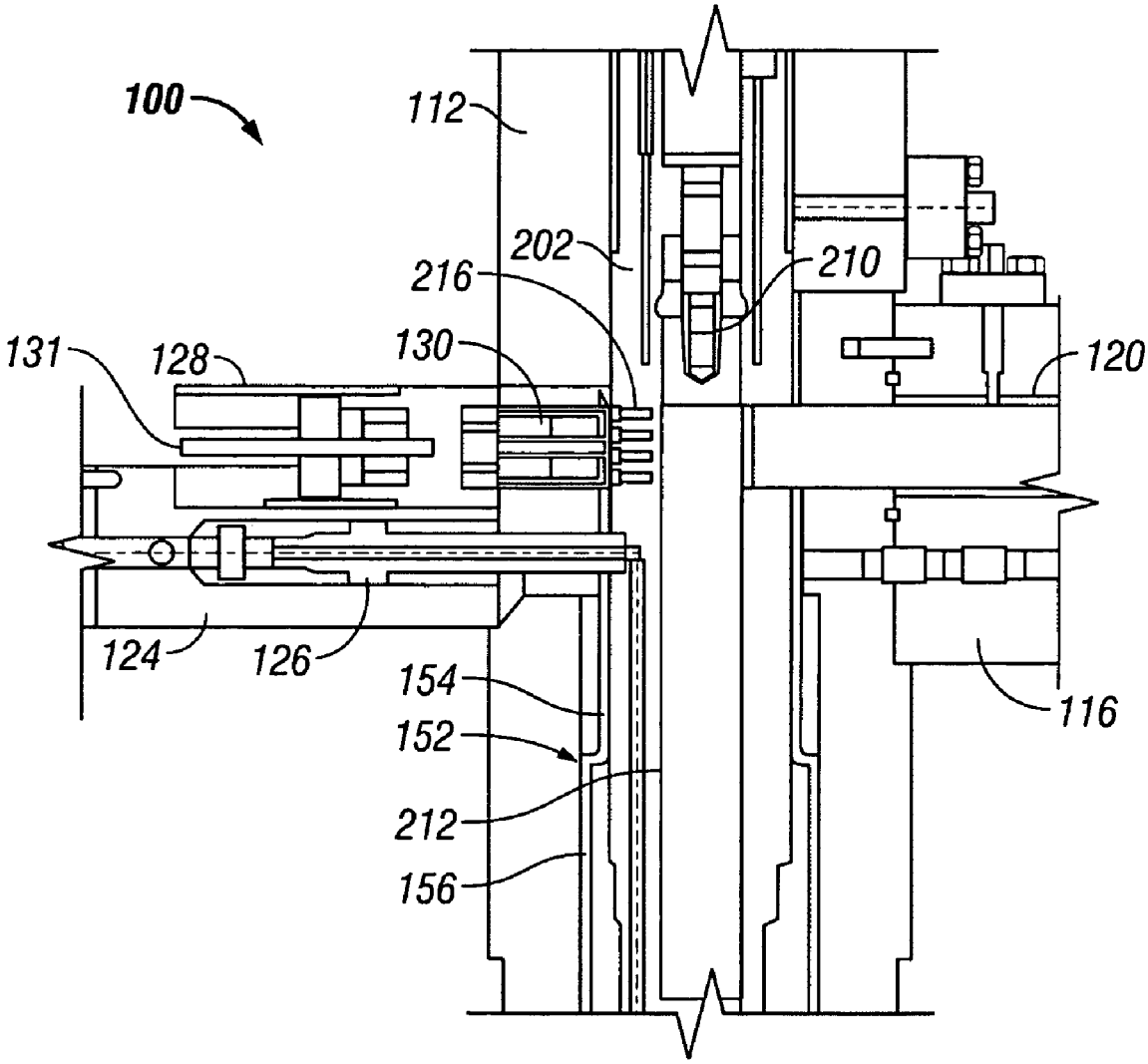
Figure 2D:
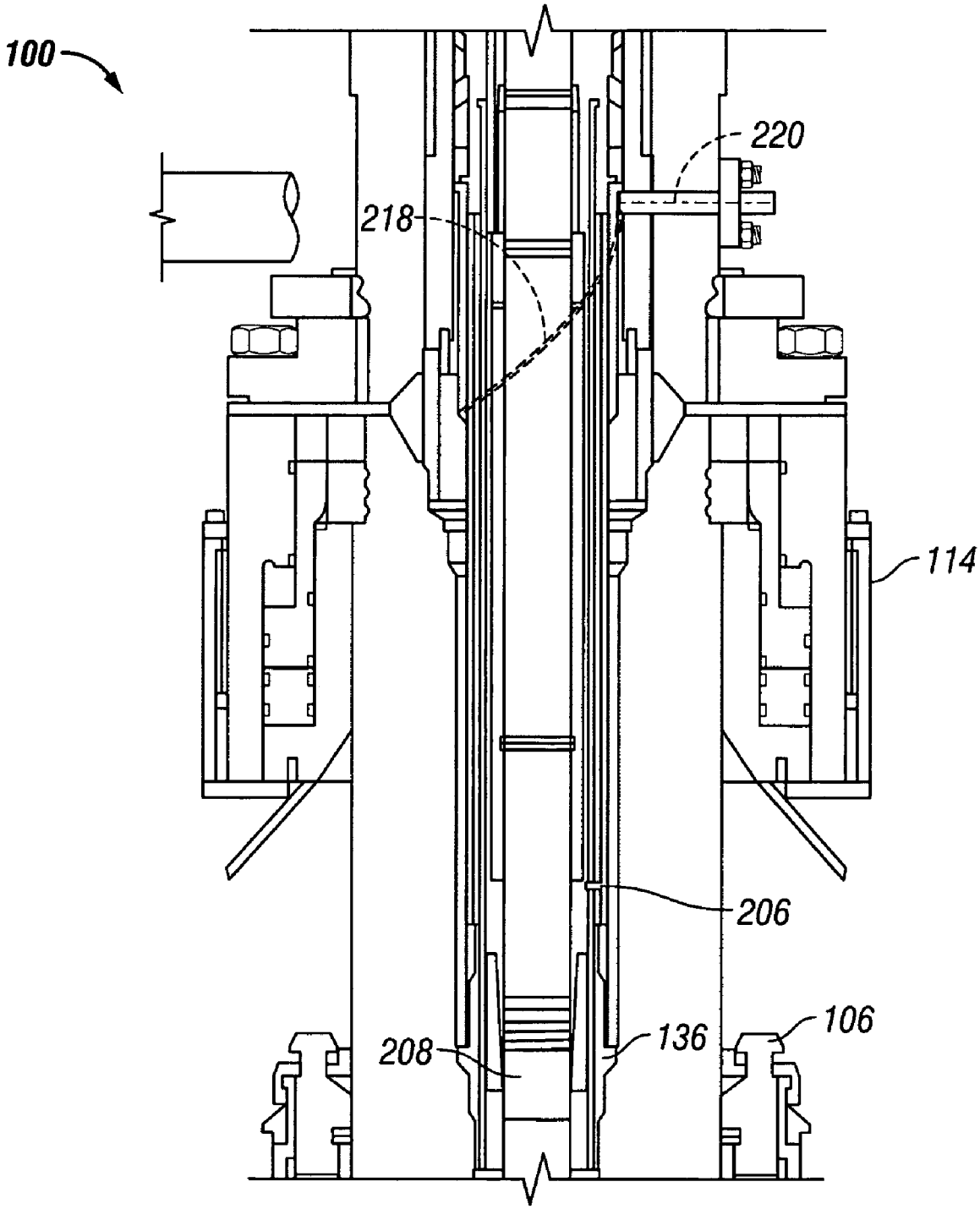

FIGS. 2A–2D depict an insert 202 being inserted into the well completion system 100. FIG. 2A is an overall view of the well completion system 100 and FIGS. 2B–2D are enlarged views of portions of the well completion system 100. Prior to installing the insert 202, the sliding isolation sleeve 152 is actuated to the upper position to protect the horizontal penetrators 130, the production isolation sleeve 120, and the annulus isolation sleeve 126. In the illustrated embodiment, an insert running tool 204 is suspended on the running string 142 and is used to install the insert 202. Thus, by way of example and illustration, the insert running tool 204 is but one means for performing an operation within at least one of the wellhead 108 and the Christmas tree 112 employed in accordance with the present invention. In the illustrated embodiment, the insert 202 extends downwardly into the wellhead 108 and includes an isolation sleeve 206 for engaging a bore 208 of the tubing hanger 136. An orientation groove 218 (shown in FIGS. 2A and 2F as a helical groove) cooperates with a pin 220 to orient the insert 202 within the Christmas tree 112.

Once the insert 202 has been landed in the wellhead 108, the sliding isolation sleeve 152 is actuated to the lower position, as illustrated in FIGS. 2A and 2B. The horizontal penetrators 130, the production isolation sleeve 120, and the annulus isolation sleeve 126 are each extended to engage the insert 202. In the illustrated embodiment, the insert 202 includes a wireline plug 210 and directs the flow of produced fluids from the production tubing string 138, through the insert 202 and the production isolation sleeve 120, and into the production valve block 116. The annulus isolation sleeve 126 communicates with an annulus bore 212 defined by the insert 202, which is in communication with a production annulus 214 between the production tubing string 138 and the production casing string 134. The functions of the insert 202 and any downhole devices can be controlled by an ROV or external umbilical attached to the horizontal penetrator assembly 128 when the horizontal penetrators 130 are engaged with control receptacles 216 of the insert 202.

While the horizontal penetrators 130 have been shown and described herein as being used with a tubing hanger running tool 140 and an insert running tool 204, the present invention is not so limited. Rather, one or more of the horizontal penetrators 130 may engage one or more control receptacles in any desired tool disposed within the bore 122 of the Christmas tree 112. For example, one or more horizontal penetrators 130 may engage control receptacles of an insert retrieval tool (not shown) so that the tool may be remotely operated, via an ROV, an external umbilical, or the like, to remove the insert 202. Further, one or more horizontal penetrators 130 may engage control receptacles of a tubing hanger retrieval tool (not shown) so that the tool may be remotely operated, via an ROV, an external umbilical, or the like, to remove the tubing hanger 136.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A well completion system, comprising:

a completion device defining a bore therein attached to a wellhead;

a tool, disposed within the bore, comprising an operational element and a control receptacle in communication with the operational element;

a horizontal penetrator assembly disposed external to the completion device and comprising at least one horizontal penetrator capable of being extended into and retracted from the bore to engage the control receptacle such that the horizontal penetrator is in communication with the operational element of the tool; and a sliding isolation sleeve, disposed within the bore, for selectively protecting the at least one horizontal penetrator when retracted from the bore, wherein the sliding isolation sleeve is capable of being operated by at least one of a remotely operated vehicle and an external umbilical.

2. A well completion system, according to claim 1, wherein the completion device is a Christmas tree.

3. A well completion system, according to claim 1, wherein the control receptacle is an electrical receptacle.

4. A well completion system, according to claim 1, wherein the horizontal penetrator assembly further comprises a coupling for engaging an external umbilical.

5. A well completion system, according to claim 1, further comprising an extendable isolation sleeve capable of being extended into and retracted from the bore of the completion device, wherein the sliding isolation sleeve is capable of selectively protecting the extendable isolation sleeve when retracted from the bore.

6. A well completion system, comprising:

a completion device defining a bore therein attached to a wellhead;

a retrievable tubing hanger running tool, disposed within the bore, comprising an operational element and a control receptacle in communication with the operational element; and a horizontal penetrator assembly disposed external to the completion device and comprising at least one horizontal penetrator capable of being extended into and retracted from the bore to engage the control receptacle such that the horizontal penetrator is in communication with the operational element of the retrievable tubing hanger running tool.

7. A well completion system, comprising:

a completion device defining a bore therein attached to a wellhead;

a retrievable insert running tool, disposed within the bore, comprising an operational element and a control receptacle in communication with the operational element; and a horizontal penetrator assembly disposed external to the completion device and comprising at least one horizontal penetrator capable of being extended into and retracted from the bore to engage the control receptacle such that the horizontal penetrator is in communication with the operational element of the retrievable insert running tool.

8. A well completion system, comprising:

a completion device defining a bore therein attached to a wellhead;

a retrievable tool, disposed within the bore, comprising an operational element and a hydraulic control receptacle in communication with the operational element; and a horizontal penetrator assembly disposed external to the completion device and comprising at least one horizontal penetrator capable of being extended into and retracted from the bore to engage the hydraulic control receptacle such that the horizontal penetrator is in communication with the operational element of the retrievable tool.

9. A method, comprising:

inserting a tool into a bore of a completion device;

extending a horizontal penetrator into the bore;

engaging the horizontal penetrator with a control receptacle of the tool;

operating an element of the tool via the horizontal penetrator; and actuating a sliding isolation sleeve to protect the horizontal penetrator prior to inserting the tool into the bore, wherein actuating the sliding isolation sleeve further comprises actuating the sliding isolation sleeve with one of a remotely operated vehicle and an external umbilical.

10. A method, according to claim 9, wherein engaging the control receptacle further comprises extending the horizontal penetrator into the bore of the completion device.

11. A method, according to claim 9, wherein operating the element of the tool further comprises transmitting electrical energy through the horizontal penetrator to operate the element of the tool.

12. A method, according to claim 9, wherein operating the element of the tool further comprises operating the element of the tool with one of a horizontal penetrator and an external umbilical.

13. A method, according to claim 9, wherein actuating the sliding isolation sleeve further comprises actuating the sliding isolation sleeve to protect an extendable isolation sleeve.

14. A method, according to claim 9, further comprising disengaging the horizontal penetrator from the control receptacle.

15. A method, comprising:

running a retrievable tool having a device coupled thereto into a bore of a completion device on a running string;

engaging a horizontal penetrator with a control receptacle of the retrievable tool; and operating an element of the retrievable tool via the horizontal penetrator so as to position said device within said bore.

16. The method of claim 15, further comprising actuating a sliding isolation sleeve to expose the horizontal penetrator prior to engaging said horizontal penetrator with said control receptacle, wherein actuating the sliding isolation sleeve further comprises actuating the sliding isolation sleeve with one of a remotely operated vehicle and an external umbilical.

17. The method of claim 15, farther comprising:

after operating said element of said retrievable tool, disengaging said horizontal penetrator with said control receptacle; and retrieving said retrievable tool.

18. A method, comprising:

inserting a retrievable tool into a bore of a completion device;

using a remotely operated vehicle to extend a horizontal penetrator;

engaging the horizontal penetrator with a control receptacle of the retrievable tool; and operating an element of the retrievable tool via the horizontal penetrator.

19. The method of claim 18, further comprising actuating a sliding isolation sleeve to expose the horizontal penetrator prior to engaging said horizontal penetrator with said control receptacle, wherein actuating the sliding isolation sleeve further comprises actuating the sliding isolation sleeve with one of a remotely operated vehicle and an external umbilical.

20. The method of claim 18, farther comprising:

after operating said element of said retrievable tool, disengaging said horizontal penetrator with said control receptacle; and retrieving said retrievable tool.

21. A method, comprising:

inserting a retrievable tool having a device coupled thereto into a bore of a completion device;

using an external umbilical to extend a horizontal penetrator into the bore of the completion device;

engaging the horizontal penetrator with a control receptacle of the retrievable tool; and operating an element of the retrievable tool via the horizontal penetrator so as to position said device within said bore.

22. The method of claim 21, further comprising actuating a sliding isolation sleeve to expose the horizontal penetrator prior to engaging said horizontal penetrator with said control receptacle, wherein actuating the sliding isolation sleeve farther comprises actuating the sliding isolation sleeve with one of a remotely operated vehicle and an external umbilical.

23. The method of claim 21, farther comprising:

after operating said element of said retrievable tool, disengaging said horizontal penetrator with said control receptacle; and retrieving said retrievable tool.

24. A method, comprising:

inserting a retrievable tool into a bore of a completion device;

engaging a horizontal penetrator with a control receptacle of the retrievable tool; and transmitting hydraulic fluid through the horizontal penetrator to operate an element of the retrievable tool via the horizontal penetrator.

25. A method, comprising:

inserting a retrievable tool having a device coupled thereto into a bore of a completion device;

extending a horizontal penetrator into the bore;

engaging the horizontal penetrator with a control receptacle of the retrievable tool; and operating an element of the retrievable tool via the horizontal penetrator so as to position said device within said bore, wherein operating the element of the tool further comprises transmitting electrical signals from the element of the tool through the horizontal penetrator.

26. The method of claim 25, further comprising actuating a sliding isolation sleeve to expose the horizontal penetrator prior to engaging said horizontal penetrator with said control receptacle, wherein actuating the sliding isolation sleeve further comprises actuating the sliding isolation sleeve with one of a remotely operated vehicle and an external umbilical.

27. The method of claim 25, farther comprising:

after operating said element of said retrievable tool, disengaging said horizontal penetrator with said control receptacle; and retrieving said retrievable tool.

28. A method, comprising:

inserting a retrievable tool having a device coupled thereto into a bore of a completion device;

extending a horizontal penetrator into the bore;

actuating a sliding isolation sleeve to expose the horizontal penetrator;

engaging the horizontal penetrator with a control receptacle of the retrievable tool;

operating an element of the retrievable tool via the horizontal penetrator so as to position said device within said bore.

29. A method, according to claim 28, wherein actuating the sliding isolation sleeve further comprises actuating the sliding isolation sleeve to expose an extendable isolation sleeve.

30. The method of claim 28, further comprising actuating a sliding isolation sleeve to expose the horizontal penetrator prior to engaging said horizontal penetrator with said control receptacle, wherein actuating the sliding isolation sleeve farther comprises actuating the sliding isolation sleeve with one of a remotely operated vehicle and an external umbilical.

31. The method of claim 28, further comprising:

after operating said element of said retrievable tool, disengaging said horizontal penetrator with said control receptacle; and retrieving said retrievable tool.

32. A well completion system, comprising:

a completion device defining a bore therein attached to a wellhead;

a retrievable tool for positioning a device within said bore, disposed within the bore, comprising an operational element and a control receptacle in communication with the operational element;

a horizontal penetrator assembly disposed external to the completion device and comprising at least one horizontal penetrator capable of being extended into and retracted from the bore to engage the control receptacle such that the horizontal penetrator is in communication with the operational element of the retrievable tool, the horizontal penetrator assembly comprising a coupling for engaging a remotely operated vehicle; and a sliding isolation sleeve, disposed within the bore, for selectively protecting the at least one horizontal penetrator when retracted from the bore, wherein the sliding isolation sleeve is capable of being operated by at least one of a remotely operated vehicle and an external umbilical.

* * * * *

UNITED STATES PATENT AND TRADEMARK OFFICE

CERTIFICATE OF CORRECTION

PATENT NO. : 7,165,620 B2
APPLICATION NO. : 10/328535
DATED : January 23, 2007
INVENTOR(S) : Scott Steedman It is certified that error appears in the above-identified patent and that said Letters Patent is hereby corrected as shown below:

Col. 7, line 33 (claim 17, line 1), change “farther” to -- further --.

Col. 7, line 53 (claim 20, line 1), change “farther” to -- further --.

Col. 8, line 5 (claim 22, line 5), change “farther” to -- further --.

Col. 8, line 8 (claim 23, line 1), change “farther” to -- further --.

Col. 8, line 40 (claim 27, line 1), change “farther” to -- further --.

Col. 8, line 65 (claim 30, line 5), change “farther” to -- further --.

Signed and Sealed this

Thirteenth Day of March, 2007

JON W. DUDAS
*Director of the United States Patent and Trademark Office*